US005325877A

United States Patent [19]

Young et al.

[11] Patent Number: 5,325,877

[45] Date of Patent: Jul. 5, 1994

[54] TOBACCO RECONSTITUTION PROCESS

[75] Inventors: Harvey J. Young, Advance; Edward J. Stephen Sohn, Lewisville; Lila H. O'Connor, Winston-Salem, all of N.C.

[73] Assignee: R. J. Reynolds Tobacco Company, Winston-Salem, N.C.

[21] Appl. No.: 96,768

[22] Filed: Jul. 23, 1993

[51] Int. Cl.[5] ..... A24B 3/14

[52] U.S. Cl. ..... 131/370; 131/372

[58] Field of Search ..... 131/290, 297, 298, 300, 131/370, 372–375; 162/77, 91, 99

[56] References Cited

U.S. PATENT DOCUMENTS

| | | |
|---|---|---|
| 2,708,175 | 5/1955 | Samfield et al. . |
| 2,845,933 | 8/1958 | Samfield et al. . |
| 3,353,541 | 11/1967 | Hind et al. . |
| 3,385,303 | 5/1968 | Hind et al. . |
| 3,386,449 | 6/1968 | Hind . |
| 3,386,450 | 6/1968 | Seligman et al. . |
| 3,398,754 | 9/1968 | Tughan . |
| 3,409,026 | 11/1968 | Hind et al. . |
| 3,411,514 | 11/1968 | Hind et al. . |
| 3,411,515 | 11/1968 | Hind et al. . |
| 3,420,241 | 1/1969 | Hind et al. . |
| 3,428,053 | 2/1969 | Schoenbaum et al. . |
| 3,435,829 | 4/1969 | Hind et al. . |
| 3,464,422 | 9/1969 | Light . |
| 3,480,018 | 11/1969 | Fairchild . |
| 3,483,874 | 12/1969 | Hind . |
| 3,540,455 | 11/1970 | Fiore . |
| 3,540,456 | 11/1970 | McGlumphy et al. . |
| 3,616,801 | 11/1971 | Hind . |
| 3,760,815 | 9/1973 | Deszyck . |
| 3,847,164 | 11/1974 | Mattina et al. . |
| 4,182,349 | 1/1980 | Selke . |
| 4,270,552 | 6/1981 | Jenkins et al. . |
| 4,333,484 | 6/1992 | Keritsis . |
| 4,337,783 | 7/1992 | Keritsis . |
| 4,341,228 | 7/1982 | Keritsis et al. . |
| 4,421,126 | 12/1983 | Gellatly . |
| 4,611,608 | 9/1986 | Vos et al. . |
| 4,674,519 | 6/1987 | Keritsis et al. . |
| 4,706,692 | 11/1987 | Gellatly . |
| 4,861,427 | 8/1989 | Johnson et al. . |
| 4,874,000 | 10/1989 | Tamol et al. . |
| 4,880,018 | 11/1989 | Graves, Jr. et al. . |
| 4,962,774 | 10/1990 | Thomasson et al. . |
| 4,972,854 | 11/1990 | Kiernan . |
| 4,987,906 | 1/1991 | Young et al. . |
| 5,025,814 | 6/1991 | Raker . |
| 5,099,864 | 3/1992 | Young et al. . |
| 5,101,839 | 4/1992 | Jakob et al. . |
| 5,143,097 | 9/1992 | Sohn et al. ..... 131/372 X |
| 5,159,942 | 11/1992 | Brinkley et al. . |
| 5,203,354 | 4/1993 | Hickle . |

FOREIGN PATENT DOCUMENTS

0535834A1 4/1993 European Pat. Off. .

OTHER PUBLICATIONS

*Tobacco Encyclopedia,* Edited by Voges, pp. 389–390, TJI (1984).

Silberstein, *TJI,* vol. 1, pp. 26–29 (1985).

*Primary Examiner*—Jennifer Bahr

[57] ABSTRACT

The invention relates to a process for collecting dispersed plant material particles during the formation of a reconstituted plant material, such as a reconstituted tobacco material. The process involves extracting components from a plant material using a solvent having an aqueous character. As such, an aqueous plant material extract and a water insoluble tobacco portion are provided. At least a portion of the aqueous extract is separated from the insoluble portion. The insoluble portion is formed into a desired shape (e.g., a sheet-like shape). Excess solvent is removed from the formed insoluble plant portion. The removed solvent has plant material particles dispersed therein and is collected. A portion of the excess solvent is removed from the dispersed plant material particles. The dispersed plant material particles are then collected.

28 Claims, 2 Drawing Sheets

TOBACCO RECONSTITUTION PROCESS

BACKGROUND OF THE INVENTION

The present invention relates to the processing of plant materials, and in particular to a process for providing a reconstituted plant material such as a reconstituted tobacco material.

Cigarettes are popular smoking articles which have a substantially cylindrical rod shaped structure and include a charge of tobacco material surrounded by a wrapper, such as paper, thereby forming a so-called "tobacco rod." It has become desirable to manufacture a cigarette having a cylindrical filter aligned in an end-to-end relationship with the tobacco rod.

Typically, a filter includes cellulose acetate circumscribed by plug wrap, and is attached to the tobacco rod using a circumscribing tipping material. See, Baker, *Prog. Ener. Combust. Sci.*, Vol. 7 pp. 135–153 (1981).

Typical cigarettes include blends of various tobaccos, such as the flue-cured, Burley, Maryland and Oriental tobaccos. Cigarette blends also can include certain amounts of processed and reconstituted tobacco materials. Reconstituted tobacco materials often are manufactured from tobacco stems, dust and scrap using papermaking processes. See, *Tobacco Encyclopedia*, edit. by Voges, pp. 389–390, TJI (1984); U.S. Pat. Nos. 4,421,126 to Gellatly, 4,962,774 to Thomasson et al., 4,987,906 to Young et al., 5,056,537 to Brown et al., 5,099,864 to Young et al., U.S. Pat. No. 5,143,097 to Sohn et al. and 5,159,942 to Brinkley et al.; EPO patent application No. 535,834; and commonly assigned, copending U.S. Ser. Nos. 07/931,248 and 07/931,249 both filed Aug. 17, 1992.

When providing reconstituted tobacco materials, it is desirable to make efficient use of tobacco material (i.e., the stems, dust, scrap and other materials used to provide a commercially useable material). As such it is desirable to maximize the amount of tobacco material used and to avoid waste. It would be desirable to provide an efficient and effective process for utilizing a substantial portion of plant material during a process for providing a reconstituted plant material from such plant material. Moreover, it would be desirable to increase the amount of tobacco material used and to reduce the amount of waste plant material which must be disposed.

SUMMARY OF THE INVENTION

To this end, the present invention provides a process which facilitates employing as much of a plant (e.g., tobacco) material as possible when providing processed plant materials and to avoid unnecessary loss of plant or tobacco material during processing. As a consequence, the tobacco processor or cigarette manufacturer can provide a commercially acceptable processed plant or tobacco material having certain desirable attributes while avoiding disposal concerns associated with solid waste (i.e., tobacco dust, stem and scrap) or with processed water used in treating plant or tobacco materials.

The process of the present invention relates to collecting, dispersed plant material particles during the formation of a reconstituted plant material, such as a reconstituted tobacco material. The process involves extracting components from a plant material (e.g., tobacco material) using a solvent having an aqueous character. As such, an aqueous tobacco extract and a water insoluble plant material portion are provided. At least a portion of the aqueous extract is separated from the insoluble portion. The insoluble portion is formed into a desired shape (e.g., a sheet-like shape). Excess solvent is removed from the formed insoluble plant portion. The removed excess solvent has plant material particles dispersed therein and is collected. Typically, the solids content of the removed excess solvent ranges from about 0.05 to 1 percent based on the weight of excess solvent and the dispersed plant material. A portion of the excess solvent is removed from the dispersed plant material particles. The dispersed plant material particles are then collected and concentrated (e.g., by screening followed by centrifuging).

The collected and concentrated dispersed plant material is a refined, captured plant material. The collected and concentrated dispersed plant material particles can then be used in a variety of ways. For example, the dispersed plant material particles can be sized or coagulated and used as a smokable material. The dispersed plant material particles can be added back to a formed pulp during a papermaking process or added to a formed pulp during a casting process. They can be contacted with a tobacco extract and added to a formed pulp or a reconstituted tobacco material. The dispersed plant material particles can be made into a sheet material such as by casting in the manner described, for example, in U.S. Pat. No. 5,099,864 to Young et al. or commonly assigned, copending U.S. Ser. Nos. 07/931,248 and 07/931,249 both filed Aug. 17, 1993. The dispersed plant material can be extruded such as described in U.S. Pat. Nos. 4,821,749 to Toft et al. and 4,880,018 to Graves et al.

A process of providing a reconstituted plant (tobacco) material is also provided. The process involves extracting components from a tobacco material using a solvent having an aqueous character. As such, an aqueous tobacco extract and a water insoluble tobacco portion are provided and are separated. The insoluble tobacco portion is subjected to conditions sufficient to release tobacco pectins to provide a slurry having released tobacco material pectins. These conditions can include contacting the insoluble tobacco portion with a pectin release agent (e.g., diammonium hydrogen orthophosphate). Preferably, the slurry is formed into a predetermined shape and excess solvent is removed, and then the pectin release agent is added to the slurry.

The excess solvent has dispersed plant material particles therein. A portion of the excess solvent is removed from the dispersed plant material particles. The dispersed plant material particles are then collected and concentrated using, for example, screening and centrifuge. The collected dispersed plant material particles can be applied to a previously formed slurry. The formed slurry with the collected dispersed plant material particles applied thereto is then subjected if desired, to conditions sufficient to crosslink the released pectins to provide a reconstituted plant material. Various other additives (e.g., aerosol-forming compounds) can be added to the slurry or formed slurry prior to the crosslinking step. These various additives will be bonded into the final reconstituted plant material (tobacco) sheet.

The resulting reconstituted tobacco material can be employed using techniques known in the art. For example, the reconstituted tobacco material can be provided in a sheet-like form having a thickness approximating that of tobacco leaf lamina; and the material can be blended with other tobacco materials, cut to the desired size, and employed as smokable cut filler for the manufacture of cigarettes.

Reconstituted tobacco materials which are manufactured according to the process of the present invention have excellent smoking properties; and when smoked, exhibit desirable sensory attributes. Certain reconstituted tobacco materials also exhibit good wet strength and improved integrity. Certain tobacco materials can have high levels of aerosol-forming materials incorporated therein, and as such, can be used as smokable materials or as substrate materials in those types of cigarettes described, for example, in U.S. Pat. No. 5,101,839 to Jakob et al., European patent application No. 545,186 and U.S. Pat. application Ser. No. 08/040,227, filed Mar. 30, 1993.

DETAILED DESCRIPTION OF THE PREFERRED EMBODIMENTS

Figure 1:
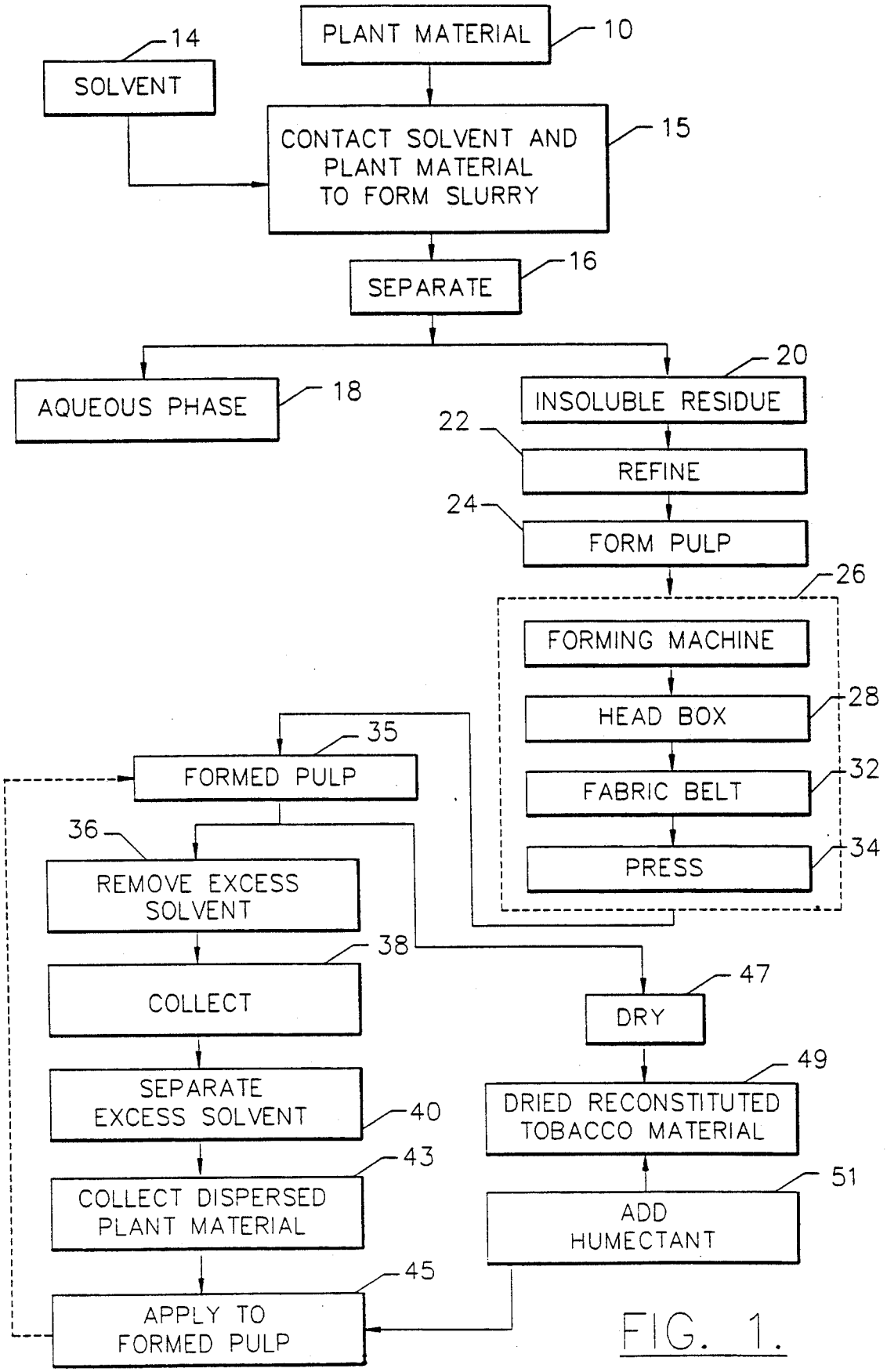
FIGS. 1 and 2 are schematic diagrams of steps representative of embodiments of the present invention.

Referring to FIG. 1, the plant material 10 (e.g., tobacco material) is contacted with a solvent 14 having an aqueous character (e.g., tap water) under conditions such that solvent soluble components of the plant material are extracted by the solvent. The mixture 15, which is an aqueous plant material slurry, is subjected to separation conditions 16 to provide plant material extract components in an aqueous phase 18 (e.g., water and extract) and a solvent insoluble plant material residue 20. The manner of separation of the liquid extract from the insoluble residue can vary and will be within the skill of one in the art.

The water insoluble residue 20 (i.e., extracted tobacco material) can be refined 22 using papermaking type refiners such as disc refiners, conical refiners, or the like. As such, the residue is subjected to a size reduction step and thereby is formed into pulp 24 for use in the subsequent manufacture of a reconstituted plant material product. The refined pulp 24 is transferred to a forming machine 26 consisting of a headbox 28, a continuous fabric or wire mesh belt 32, and a series of presses 34. Such a forming machine is common in the papermaking industry. The selection and operation of a forming machine will be apparent to the skilled artisan. The pulp is laid onto the fabric or wire mesh belt 32 (e.g., after being laid onto a forming cylinder) and is thereby formed into a sheet-like shape. Excess solvent is removed 36 from the pulp using the series of presses 34 after initial solvent removal on the fabric or wire belt.

The excess solvent removed or separated during refining and forming into a pulp is collected 38. The excess solvent has plant material particles dispersed therein. At least a portion of the excess solvent is separated 40 from the dispersed plant material to provide a collected and concentrated dispersed plant material. Such separation can include screening using a 35 Tyler mesh screen, for example, and centrifuging at sufficient force to separate at least about 85 percent, and sometimes at least about 90 percent and often at least about 98 percent of the dispersed plant material from the excess solvent. Representative centrifuges are a Sharples P-3400-S centrifuge and a Bird Centrifilter centrifuge, the operation of which will be within the skill of one in the art. Another exemplary separation technique is freeze drying the excess solvent to separate at least about 85 percent, sometimes at least about 98 percent of dispersed plant material from the excess solvent. Another separation technique is to concentrate the excess solvent in vacuo and then further separating using a centrifuge.

The dispersed plant material particles are then collected 43. The collected and concentrated dispersed plant material particles can be, for example, applied 45 to a previously formed plant material pulp and dried 47 to provide a reconstituted tobacco material 49. Extract from a prior extraction could be contacted with the plant material and then applied (e.g., sprayed) to a web of previously formed reconstituted plant material. Optionally, a humectant 51 (i.e, an aerosol-forming compound) or other additive can be applied (e.g., using a size press) to the formed pulp 45 or the dried reconstituted tobacco material 49.

Figure 2:
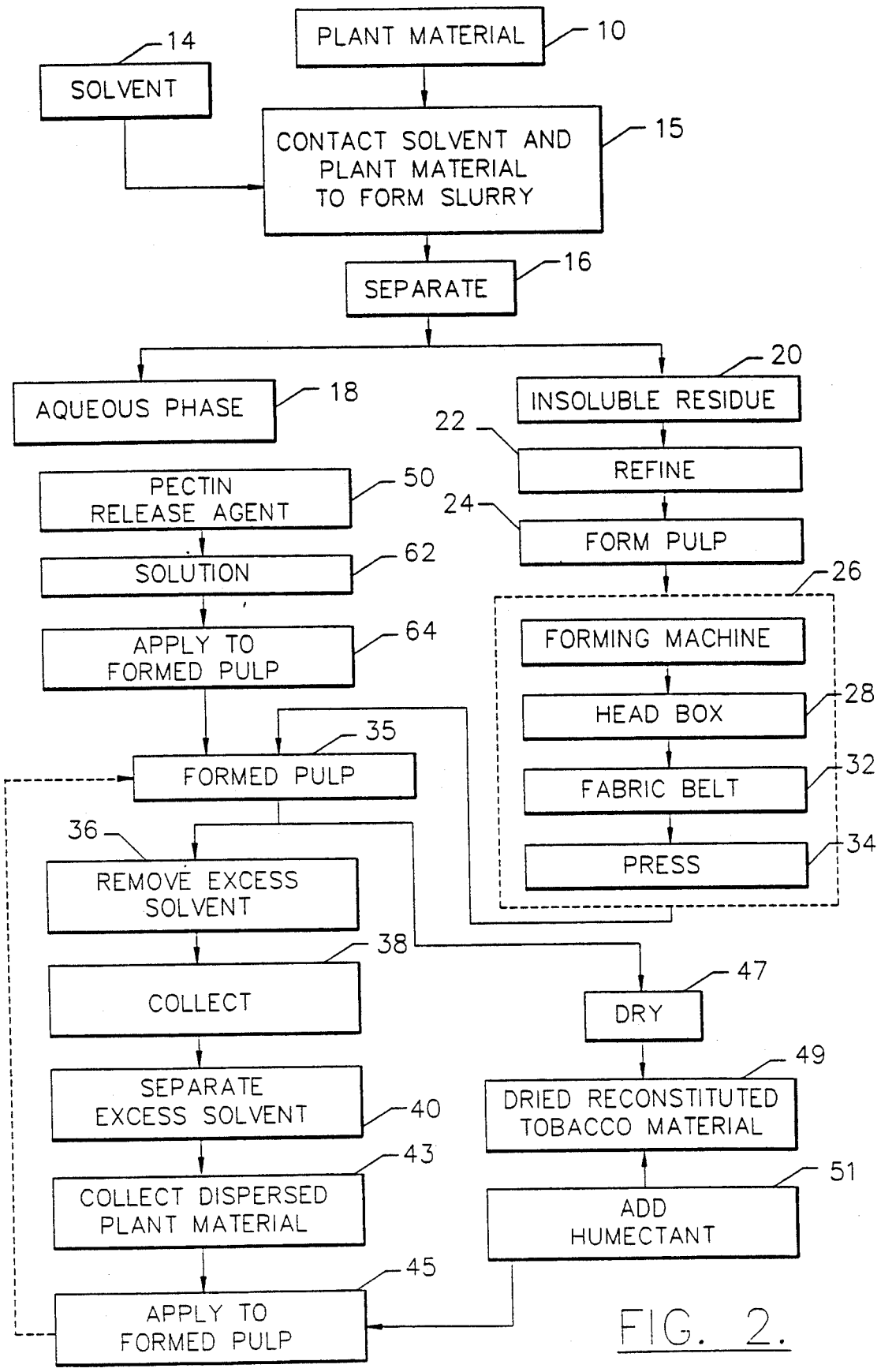

Referring to FIG. 2, an alternative embodiment is illustrated. Like numerals refer to like elements. Plant material 10 is contacted with a solvent 14 having an aqueous character (e.g., tap water) under conditions such that solvent soluble components of the plant material are extracted by the solvent. The mixture 15, which is an aqueous plant material slurry, is subjected to separation conditions 16 to provide plant material extract components in an aqueous phase 18 (e.g., water and extract) and a solvent insoluble plant material residue 20. The extract components in aqueous phase 18 optionally can be subjected to further processing steps to provide a processed liquid extract such as described in EPO patent application No. 535,834 to Young et al., the disclosure of which is incorporated herein by reference.

The insoluble plant portion is subjected to conditions sufficient to release tobacco pectins, for example contacting with a pectin release agent 50, before or after forming a slurry. A preferred pectin release agent is diammonium hydrogen orthophosphate. The pectin release agent is provided as an aqueous solution 62, and the solution is applied 64 to the insoluble plant portion preferably after forming into a predetermined shape and removal of excess solvent. The pectin release agent preferably can also be applied to the formed pulp during the papermaking process using techniques such as spraying, size pressing, wicking and the like. Typically, enough aqueous solution 62 including diammonium hydrogen orthophosphate as a pectin release agent is applied to the pulp to provide about 2 percent to about 5 percent addition of pectin release agent to the pulp, based on the dry weight of the pulp. The slurry is then formed into pulp 24 and is formed into a predetermined shape as described previously in FIG. 1, namely is dried 47 to form a dried reconstituted tobacco material 49.

The excess solvent from the process is collected 38. At least a portion of the excess solvent is separated 40 from the dispersed plant material. The dispersed plant material is collected 43. The collected dispersed plant material can be applied to a previously formed pulp or slurry or otherwise used.

The formed pulp or slurry can be subjected 48 to conditions sufficient to crosslink the released pectins. For example, the formed pulp having released pectins can have the pectins crosslinked by contacting with a crosslinking agent and drying to provide a reconstituted plant material (e.g., tobacco material). For example, liquid tobacco extract can be sprayed onto the pulp. The sheet-like pulp having the liquid extract applied thereto is passed through a dryer such as an apron dryer, can dryer or the like. If desired, a further amount of the liquid extract can be applied to one or both sides of the formed pulp, (e.g., applied by means of a size press) and the resulting material can be passed through another dryer. Alternatively, the resulting material can be passed through the dryer or dryers more than one time. The dried reconstituted plant material which results can be collected and is processed further as required for use as smokable filler for cigarettes.

Optionally a humectant 51 or other aerosol-forming compound can be incorporated into the reconstituted tobacco material, applied to the dispersed plant material particles or applied to cast or extruded dispersed plant material particles. For example, glycerin, glycerol, triethylene glycol and Hystar TPF can be mixed together to form a humectant. Preferably, the amount of humectant ranges from about 0.5 to 3 percent, and preferably from about 1 to about 2 percent based on the dry weight of the tobacco material used. Additional amounts of humectants can be utilized if particular aerosol-forming characteristics are desired such as described in U.S. Pat. No. 5,183,062 to Clearman et al., the disclosure of which is incorporated herein by reference. The amount of humectant applied is up to 90 percent, often up to 80 percent and sometimes up to 60 percent based on dry weight of tobacco material used, and typically the amount is more than 5 percent, often more than 20 percent, sometimes more than 30 percent and typically at least 50 percent. It is recognized that the humectant can be added in combination with the pectin release agent. Other additives can include natural non-volatile mixtures such as herbs or spices, or flavorants like vanilla, cocoa, licorice, Irish moss, etc.

Plant materials used in the process of the present invention can vary. Most preferably, the plant materials have pectins and are tobacco materials. The tobacco materials which are reconstituted according to the present invention are of a form such that, under extraction conditions, a portion thereof is soluble in (i.e., extracted by) the extraction solvent; and a portion thereof is insoluble in (i.e., not extracted by) the extraction solvent. The insoluble portion includes polymeric materials, such as cellulosics, pectins, and the like. Examples of suitable types of tobaccos include flue-cured, Oriental, Burley and Maryland tobaccos, although other types of tobacco can be employed. The tobacco material generally has been aged, and can be in the form of laminae (e.g., strip or cut filler) and/or stem, or can be in a processed form (e.g., previously reconstituted or volume expanded). Typically, the tobacco material employed is a waste material and/or processing by-product such as fines, dust, scrap or stem. All or part of the tobacco material can be previously cased and/or top dressed. The aforementioned materials can be processed separately, or as blends thereof.

The tobacco material is contacted with a solvent having an aqueous character. Such a solvent consists primarily of water, normally greater than 90 weight percent water, and can be essentially pure water in certain circumstances. Essentially pure water includes deionized water, distilled water and tap water. However, the solvent can include water having substances such as Ph buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the solvent can vary. Typically, the weight of solvent relative to the plant material is greater than 4:1, and often times greater than 5:1. The amount of solvent relative to plant material depends upon factors such as the type of solvent, the temperature at which the extraction is performed, the type or form of plant which is extracted, the manner in which contact of the plant material and solvent is conducted, and other such factors. The manner of contacting the tobacco material and solvent is not particularly critical. Representative methods for extracting tobacco materials with solvents are set forth in U.S. Pat. Nos. 5,005,593 to Fagg and 5,025,812 to Fagg, et al., the disclosures of which are incorporated herein by reference.

The conditions under which the extraction is performed can vary. Typical temperatures range from about 50° F. to about 175° F. The solvent/plant material mixture can be agitated (e.g., stirred, shaken, or otherwise mixed) in order to increase the rate at which extraction occurs. Typically, adequate extraction of components occurs in less than about 60 minutes, and oftentimes in less than about 30 minutes. As such, an aqueous slurry is provided.

The solvent and plant material extract components are separated from the insoluble residue. The manner of separation of the components of the slurry can vary; however, it is convenient to employ conventional separation means such as filtration, centrifugation, pressing, or the like. Generally, the separation of the components of the slurry is performed while the slurry is maintained at above ambient temperature. It is desirable to provide a solution of solvent and extracted components having a very low level of suspended solids, while removing the greatest amount of solvent from the insoluble residue as is possible. Typically, the separation of the components of the aqueous slurry is performed in order to provide (i) a damp pulp; and (ii) an aqueous extract having extracted plant materials components therein. Preferably, the damp pulp has as much extract as possible removed therefrom. The aqueous extract can be concentrated for further use, or spray dried for storage and handling reasons and later dissolved in aqueous solvent.

The pulp is formed into a sheet, or other desired shape. Normally, the pulp is an extracted tobacco material having a low water extractables content. Oftentimes, as much of the water extractables as possible is removed from the pulp such that essentially no water extractables are in contact with the pulp. The pulp normally is an extracted tobacco material having less than about 25 weight percent, often less than about 20 weight percent, frequently less than about 15 weight percent, and preferably less than about 10 weight percent water extractables, on a dry weight basis. Removal of a significant amount of the extractables is desirable in order that a significant amount of water soluble alkaline earth metal ions are removed from the pulp. As such, affects of such ions during the optional alkaline earth metal crosslink destruction step are minimized or eliminated.

Typically, the pulp is laid onto a fabric, screen or wire mesh belt using known papermaking techniques and equipment. Oftentimes, damp pulp is contacted with further aqueous liquid to provide a slurry of sufficiently low solids content so as to have the pulp in a form which can be readily formed as a sheet on a fabric, screen or wire mesh belt. The formed pulp then is treated to remove excess solvent therefrom by passing the pulp through a series of presses, dryers, vacuum boxes, or the like. Techniques for removing excess solvent (water) from formed pulp will be apparent to the skilled artisan.

The excess solvent has dispersed plant material therein. Typically, the solids content of excess solvent ranges from about 0.05 to 1 percent based on the weight of the excess solvent and the dispersed plant material. Specifically the suspended solids are typically about 0.3 to 0.5 percent for solvent removed during pulp formation and typically 0.1 to 0.35 percent for solvent removed during the papermaking process. The excess solvent and dispersed plant material are separated using conventional separation techniques such as centrifuging, freeze drying, gravity setting, ultrafiltration, dissolved air flotation, etc. and the like. Preferably, the excess solvent and dispersed plant material is passed through a 35 Tyler mesh screen to remove undesired large particles. As such at least about 85 percent, often at least about 90 percent and sometimes 98 percent of the dispersed plant material is removed from the excess solvent. The recovered solids generally have a solids content of from about 5 to 15 percent, and typically about 11 to 12 percent by weight of suspended solids. The dispersed plant materials are then collected and concentrated using conventional techniques.

The collected dispersed plant material particles can be incorporated into the reconstituted tobacco material in a wide variety of ways. For example, the particles can be incorporated into the pulp prior to formation as a sheet, air laid onto the formed pulp prior to the time that the crosslinking agent is applied to the formed sheet, air laid onto the formed pulp after the time that the crosslinking agent extract is applied to the formed sheet, mixed with an aqueous tobacco extract such as described in U.S. Pat. No. 5,159,942 to Brinkley et al., the disclosure of which is incorporated herein by reference and applied to the formed sheet, or sprayed onto the formed pulp as an aqueous slurry before, during or after the time that the crosslinking agent is applied to the formed sheet. Typically, as much as about 0.1 percent, and often as much as about 5 percent, or greater of the final dry weight of final reconstituted tobacco material can be provided by dispersed plant material particles. The collected dispersed plant material can be formed into a desired shape using casting techniques such as described in U.S. Pat. No. 5,099,864 to Young et al. the disclosure of which is incorporated herein by reference, or extrusion techniques, such as described in U.S. Pat. Nos. 4,821,749 to Toft et al. and 4,880,018 to Graves et al. the disclosures of which are incorporated herein by reference or the like.

Suitable pectin release agents are described, for example, in U.S. Pat. Nos. 5,159,942 to Brinkley et al., 4,987,906 to Young et al. and 4,674,519 to Keritsis et al., the disclosures of which are incorporated herein by reference. Pectin release or crosslinking destruction agents are those which exhibit a $K_{sp}$ with calcium ions which is less than that $K_{sp}$ exhibited by the calcium ions and functionalities of the tobacco pectins which form the crosslinks of the pectins, under those conditions which the crosslink destruction agent is contacted with the extracted tobacco material. Such pectin release agents have a propensity to form salts of low solubility in water (i.e., form precipitates) or to act as chelating agents for calcium ions. Exemplary crosslink destruction agents include salts of $PO_4^{-3}$, $HPO_4^{-2}$ and $H_2PO_4^{-1}$. Representative water soluble phosphate salts include trisodium phosphate, disodium phosphate, monosodium phosphate and diammonium hydrogen orthophosphate. See, also, those pectin release agents proposed in U.S. Pat. No. 3,435,829 to Hind, et al., the disclosure of which is incorporated herein by reference.

The amount of pectin release agent which is contacted with the extracted tobacco material can vary, and can depend upon the particular pectin release agent. Typically, the amount of pectin release agent ranges from about 1 percent to about 6 percent, preferably about 2 percent to about 5 percent, based on dry weight of the plant material to which that agent is applied.

In a papermaking process, the pectin release agent and extracted plant material and/or dispersed plant particles can be combined during refining of the pulp, as the pulp enters the headbox, when the pulp is in the headbox, as the pulp exits the headbox, as the pulp is introduced to the sheet forming region of the papermaking apparatus, in the sheet forming region of the papermaking apparatus, or in the final region of the papermaking apparatus (e.g., in the suction region of the apparatus) when the moisture content of the pulp is less than about 90 percent, based on the weight of the plant material and aqueous liquid. The extracted plant material is subjected to conditions sufficient to allow release of the pectins with the extracted plant material. For certain pectin release agents, such conditions typically involve providing the aqueous liquid in contact with the pulp at pH sufficiently high so as to provide the moist pulp at a pH of about 6 to about 12, preferably about 7 to about 10. As such, the pH of the aqueous liquid in contact with the pulp can be made sufficiently high to allow release of the pectins at the time that the extracted tobacco material is contacted with the pectin release agent. Alternatively, the pH of the aqueous liquid in contact with the pulp can be made sufficient to allow for destruction of the alkaline earth metal crosslinks of the pectins at the time that the extracted tobacco material is contacted with the pectin release agent, and then the pH of the aqueous liquid in contact with the pulp can be made sufficient to allow release and migration of the pectins.

The pH of the solvent is provided at the desired level using pH adjusting agents such as ammonium hydroxide, anhydrous ammonia, potassium hydroxide, sodium hydroxide, and the like.

The formed pulp can be subjected to conditions sufficient to cause the released pectins to undergo crosslinking. Preferably, the aqueous tobacco extract or other agent capable of providing alkaline earth metal ions, such as calcium ions (e.g., an aqueous solution of calcium chloride) is applied to the formed pulp. The calcium ions are those calcium ions in a water soluble form, and can be provided as a mixture of aqueous tobacco extract and water soluble calcium salt. The amount of water soluble alkaline earth metal ions contacted with the formed pulp is at least sufficient to cause the released pectins to undergo alkaline earth metal crosslinking. For example, an aqueous tobacco extract is uniformly applied to the pulp in a sheet-like form using a series of spray nozzles, a series of sizing rollers, a wick applicator or other such means. However, the manner of applying the aqueous extract to the pulp is not particularly critical. The amount of extract applied to the extracted tobacco can vary; and can equal the amount of extract removed from the plant material during extraction, can be less than the amount of extract removed from the tobacco material during extraction, or can be more than that amount of extract removed from the tobacco material during extraction (e.g., by blending extracts). While the pectins are released and prior to forming they act as building agents and can crosslink great levels of humectants.

The separated excess solvent (water) can be recycled and used over as the solvent. Alternatively, the water can be used to wash various parts of the papermaking apparatus or can be used in other processes requiring a solvent such as water.

The reconstituted tobacco material exhibits excellent wet strength properties and improved integrity in the dry form. The final or finished reconstituted tobacco material exhibits excellent sensory attributes (e.g., flavor, aroma, harshness, mildness and aftertaste). That material typically exhibits a dry basis weight of about 90 $g/m^2$ to about 120 $g/m^2$.

The following examples are provided in order to further illustrate various embodiments of the invention but should not be construed as limiting the scope thereof. Unless otherwise noted, all parts and percentages are by weight.

EXAMPLE 1

Reconstituted tobacco sheet is provided using a papermaking process generally as described with reference to FIG. 1 using tobacco by-products comprising a blend of tobacco types. The blend includes about 65 parts Burley and flue cured tobacco stems and about 35 parts of tobacco laminae dust and scrap.

The tobacco is extracted at about 140° F. using about 8 parts tap water for each part tobacco material and is allowed to set for about 20 minutes. The resulting slurry of tobacco material in water is separated from the water insoluble pulp using a press or centrifuge. The liquid extract and pulp are collected separately. The pulp, which has a very low remaining water extractables content, is provided as a slurry by adding water. The slurry has a solids content of about 1.5 to about 2.5 percent. The resulting slurry is subjected to a shredding or fiber opening by passing the slurry through a disc refiner having a plate opening of about 20 mm to about 30 mm. About 300 pounds of the slurry of tobacco material, is passed through the disc refiner for about 20 minutes, and refined in a conical refiner to a Canadian Standard Freeness of about 125 to about 175 ml. The refined slurry is diluted using recirculated forming water from the papermaking process to provide a diluted slurry having a solids content of about 0.6 to about 1.0 percent.

The diluted pulp is transferred to a forming machine consisting of a headbox a forming wire mesh belt and a series of pressure operation of which will be apparent to the skilled artisan. Water is pulled off the slurry to provide a so-called "white water". The water can be used in manufacturing the reconstituted tobacco material (e.g, it can be used in the formation of the slurry. The white water can be processed (e.g. centrifuged) to remove the dispersed tobacco material particles. The pulp is then transferred to a fabric belt as is common in the papermaking industry. The pulp is formed into a continuous sheet having dry basis weight of about 40 to about 50 $g/m^2$. A vacuum is pulled on the bottom of the fabric belt so as to provide a damp, formed pulp having a moisture content of about 85 percent and to remove excess solvent. The removed excess solvent is sometimes referred to as "felt leg water". This felt leg water typically has a solids concentration of less than about 0.5 percent. The felt leg water is screened using a 35 Tyler mesh screen to remove any extraneous fabric particles from the fabric belt.

The formed pulp is passed through a roller press as is common to the papermaking industry to provide a damp pulp having a moisture content of about 70 to about 75 percent. The excess solvent is collected and dispersed tobacco material particles therein are separated from the solvent using a centrifuge using Sharples P-3400-S centrifuge at a flow rate of 10–20 gallons/min to provide a slurry having about 85 to 95 percent of the solids removed and to provide about 11 percent solids slurry. The slurry of collected dispersed tobacco material particles with particle sizes from 1.5 to 150 microns in length is heated, with stirring, to approximately 170° F. Based on the dry weight of the slurry, a solution providing 3.0 percent diammonium hydrogen orthophosphate solution formed by mixing 5 g of diammonium orthophosphate, 10.7 g of concentrated ammonium hydroxide and 83.4 g of water for a total weight of 100 g and 1.5 percent of ammonia is added to the slurry. The resulting slurry was mixed for approximately one minute and then transferred to the head box of a cast sheet line and cast by extruding through the nip of the head box. The cast mass is dried by impinging steam on the bottom side of the impervious steel band. The resulting cast sheet and dried product has a sheet weight of from 30 to 60 $g/m^2$ at approximately 14 percent moisture. The resulting sheet exhibited excellent wet strength and a non-tacky surface.

EXAMPLE 2

The process essentially as described in Example 1 is repeated. However, the centrifuged slurry of recovered dispersed tobacco particles, having a solids content of about 11.5 percent, is cast and dried without the addition of diammonium orthophosphate and ammonia thereto. The resulting cast material later can be disbursed in water and used as a pulp material in a papermaking process or other reconstitution process. Such material can be added prior to directly into, the headbox in a papermaking process. However, the material can be employed in the papermaking process at a stage at which the material does not have to be refined further.

EXAMPLE 3

The process essentially as described in Example 1 is repeated. However, the slurry of recovered tobacco pulp particles is combined with the aqueous tobacco extract, prior to concentration of that extract. It is noted that the slurry can be combined with the extract after the aqueous extract has been concentrated, and the resulting slurry can be concentrated further. As such, a slurry having an extract concentration of about 22 to 30 percent and a refined pulp portion of about 0.5 to about 30 percent is provided. That slurry then is applied to formed sheet of tobacco pulp, and the resulting sheet is dried to provide a reconstituted tobacco sheet. As such, the collected pulp is provided as a portion of the weight of the pulp of the formed sheet.

EXAMPLE 4

The papermaking process essentially as described in Example 1 is repeated. However, at the point that the formed pulp leaves the fabric belt at a moisture content of about 80 to 85 percent, the formed pulp is transferred to a Yankee drum dryer to dry that pulp to a moisture content of about 70 percent. To that pulp then is applied a 5 percent solution of diammonium hydrogen orthophosphate and ammonia in water. The amount of diammonium hydrogen orthophosphate is about 3 percent and the amount of ammonium is about 1.5 percent, based on the dry weight of the pulp. The pulp then is passed through a series of can dryers set at about 175° F. to about 180° F. in less than about 10 seconds (e.g., for about 3 to about 5 seconds) to provide the formed pulp at a moisture content of about 20 to 30 percent. That pulp then is dip cased with a liquid mixture comprised of 90 parts glycerine and 10 parts water, and air dried to a moisture content of about 10 to 15 percent. The resulting sheet has about 50 to 75 percent glycerine incorporated therein.

EXAMPLE 5

The process essentially as described in Example 4 is carried out. However, a liquid mixture of about 80 parts glycerine and about 20 parts aqueous tobacco extract (i.e., about 25 parts extract and about 75 parts water) is dip cased onto the pulp. As such, a reconstituted sheet having about 50 percent tobacco extract and pulp and about 50 percent glycerine, on a dry weight basis is provided.

EXAMPLE 6

The process essentially as described in Example 4 is carried out. However, a liquid mixture of glycerine and aqueous tobacco extract is dip cased onto the pulp. The aqueous tobacco extract is described at col. 11, lines 5–37 of U.S. Pat. No. 5,159,942 to Brinkley et al.; and includes about 8 parts extract and about 92 parts water. The resulting reconstituted tobacco material sheet includes about 60 to 70 percent glycerine and about 40 parts tobacco, on a dry weight base. The nicotine content of the reconstituted sheet is about 3 to about 5 percent.

That which is claimed is:

1. A process for collecting dispersed plant material particles during the formation of a reconstituted plant material, the process comprising the steps of:

(a) extracting extract components from plant material having pectins using a solvent having an aqueous character thereby providing a solvent and a plant portion insoluble in the solvent;

(b) separating at least a portion of the solvent from the insoluble plant portion;

(c) refining the insoluble plant portion in step (b) to form a pulp and forming the pulp into a predetermined shape;

(d) removing solvent from the formed insoluble plant portion, the removed solvent having plant material particles dispersed therein;

(e) collecting the solvent having dispersed plant material particles therein;

(f) separating at least a portion of the solvent from the dispersed plant material particles; and (g) collecting the dispersed plant material particles.

2. The process of claim 1 whereby the plant material is a tobacco material.

3. The process of claim 2 whereby the moisture content of the insoluble plant portion provided after step (d) ranges from about 60 percent to 85 percent, based on the weight of the plant material and solvent.

4. The process of claim 2 whereby the solid content of the excess solvent having dispersed plant material particles therein collected in step (e) ranges from about 0.05 percent to 1 percent, based on the weight of the excess solvent and the dispersed plant material.

5. The process of claim 2 whereby step (f) of separating at least a portion of the excess solvent from the dispersed plant material particles includes centrifuging at sufficient force to separate at least about 85 percent of the dispersed plant material particles from the excess solvent.

6. The process of claim 2 whereby step (f) of separating at least a portion of the excess solvent from the dispersed plant material particles includes freeze drying the excess solvent to separate at least about 85 percent of the dispersed plant material particles from the excess solvent.

7. The process of claim 2 whereby the insoluble plant portion provided in step (b) includes less than about 20 weight percent water extractables, on a dry weight basis.

8. The process of claim 2 whereby the insoluble plant portion is formed into a sheet-like shape.

9. A process for collecting dispersed plant material particles during the formation of a reconstituted plant material and utilizing the same in forming the reconstituted tobacco material, the process comprising the steps of:

(a) extracting extract components from plant material having pectins using a solvent having an aqueous character thereby providing a solvent and a plant portion insoluble in the solvent;

(b) separating at least a portion of the solvent from the insoluble plant portion;

(c) refining the insoluble plant portion provided in step (b) to form a pulp and forming the pulp into a predetermined shape;

(d) removing excess solvent, from the formed insoluble plant portion, the removed solvent having plant material particles dispersed therein;

(e) collecting the excess solvent having dispersed plant material particles therein;

(f) separating at least a portion of the excess solvent from the dispersed plant material particles;

(g) collecting the dispersed plant material particles;

(h) applying the dispersed plant material particles to a plant material pulp formed by a process comprising steps (a)–(c); and (i) drying the formed plant material pulp having the dispersed plant material particles therein to provide a reconstituted tobacco material.

10. The process of claim 9 whereby the plant material is a tobacco material.

11. The process of claim 10 whereby the moisture content of the insoluble plant portion provided in step (b) ranges from about 60 percent to 85 percent, based on the weight of the plant material and solvent.

12. The process of claim 9 whereby prior to forming the insoluble plant portion into a predetermined shape, the insoluble plant portion is subjected to conditions sufficient to release tobacco pectins to provide a slurry having released pectins.

13. The process of claim 12 further including the step of subjecting the formed plant material of step (i) to conditions sufficient to crosslink the released pectins to provide a reconstituted plant material.

14. The process of claim 12 whereby the conditions sufficient to release tobacco pectins includes contacting the slurry with a water soluble phosphate salt pectin release agent.

15. The process of claim 13 whereby the conditions sufficient to crosslink the released pectins includes contacting the formed plant material with the portion of the solvent separated from the insoluble plant portion in step (b).

16. The process of claim 9 whereby the solid content of excess solvent having dispersed plant material particles therein collected in step (e) ranges from about 0.05 percent to 1 percent, based on the weight of the excess solvent and the dispersed plant material.

17. The process of claim 9 whereby step (f) of separating at least a portion of the excess solvent from the dispersed plant material particles includes centrifuging at sufficient force to separate at least about 85 percent of the dispersed plant material particles from the excess solvent.

18. The process of claim 9 whereby step (f) of separating at least a portion of the excess solvent from the dispersed plant material particles includes freeze drying the excess solvent to separate at least about 85 percent of the dispersed plant material particles from the excess solvent.

19. The process of claim 9 whereby the insoluble plant portion provided in step (b) includes less than about 20 weight percent water extractables, on a dry weight basis.

20. The process of claim 9 whereby the insoluble plant portion is formed into a sheet-like shape.

21. A process for providing a reconstituted tobacco material, the process comprising the steps of:

(a) extracting extract components from plant material having pectins using a solvent having an aqueous character thereby providing a solvent and a plant portion insoluble in the solvent;

(b) separating at least a portion of the solvent from the insoluble plant portion;

(c) subjecting the insoluble plant portion to conditions sufficient to release tobacco pectins to provide a slurry having released tobacco pectins;

(d) refining the slurry provided in step (c) to form a pulp and forming the pulp into a predetermined shape;

(e) removing excess solvent, from the formed pulp, the removed solvent having plant material particles dispersed therein;

(f) collecting the excess solvent having dispersed plant material particles therein;

(g) separating at least a portion of the excess solvent from the dispersed plant material particles;

(h) collecting the dispersed plant material particles;

(i) applying the dispersed plant material particles to a pulp previously formed by a process comprising steps (a)-(d); and (j) subjecting the formed pulp having the dispersed plant material particles to conditions sufficient to crosslink the released pectins to provide a reconstituted tobacco material.

22. The process of claim 21 whereby the conditions sufficient to release tobacco pectins includes contacting the slurry with a water soluble phosphate salt pectin release agent.

23. The process of claim 21 whereby the conditions sufficient to crosslink the released pectins includes contacting the formed plant material with the portion of the solvent separated from the insoluble plant portion in step (b).

24. The process of claim 21 whereby the solid content of excess solvent having dispersed plant material particles therein collected in step (f) ranges from about 0.0 percent to 5 percent, based on the weight of the excess solvent and the dispersed plant material.

25. The process of claim 21 whereby step (e) of separating at least a portion of the excess solvent from the dispersed plant material particles includes centrifuging at sufficient force to separate at least about 85 percent of the dispersed plant material particles from the excess solvent.

26. The process of claim 21 whereby step (g) of separating at least a portion of the excess solvent from the dispersed plant material particles includes freeze drying the excess solvent to separate at least about 85 percent of the dispersed plant material particles from the excess solvent.

27. The process of claim 21 whereby the insoluble plant portion provided in step (b) includes less than about 20 weight percent water extractables, on a dry weight basis.

28. The process of claim 21 whereby an aerosol-forming compound is added to the formed pulp prior to step (j).

* * * * *